US005806497A

United States Patent [19]

Hosoya

[11] Patent Number: 5,806,497

[45] Date of Patent: Sep. 15, 1998

[54] METHOD OF AND APPARATUS FOR CONTROLLING FUEL INJECTION OF INTERNAL COMBUSTION ENGINE

[75] Inventor: Hajime Hosoya, Atsugi, Japan

[73] Assignee: Unisia Jecs Corporation, Kanagawa-ken, Japan

[21] Appl. No.: 815,287

[22] Filed: Mar. 11, 1997

[30] Foreign Application Priority Data

Mar. 22, 1996 [JP] Japan ..... 8-066687

[51] Int. Cl.[6] ..... F02M 51/00

[52] U.S. Cl. ..... 123/494; 123/488

[58] Field of Search ..... 123/488, 494, 123/492, 493

[56] References Cited

U.S. PATENT DOCUMENTS

| | | | |
|---|---|---|---|
| 3,688,750 | 9/1972 | O Neill | 123/494 |
| 4,426,981 | 1/1984 | Greiner et al. | 123/494 |
| 5,176,122 | 1/1993 | Ito | 123/478 |
| 5,218,941 | 6/1993 | Suzuki et al. | 123/494 |
| 5,493,902 | 2/1996 | Glidewell et al. | 123/479 |
| 5,533,492 | 7/1996 | Willey et al. | 123/488 |

FOREIGN PATENT DOCUMENTS

| | | |
|---|---|---|
| 60-30420 | 2/1985 | Japan . |

*Primary Examiner*—Thomas N. Moulis
*Attorney, Agent, or Firm*—McDermott, Will & Emery

[57] ABSTRACT

In a direct injection type gasoline engine for directly injecting fuel into each cylinder, fuel pressures supplied to each fuel injection valve are detected, and the fuel injection pulse width is detected according to the detected fuel pressures. Here, the fuel injection pulse width is corrected based on a value obtained by smoothing the detected values of the fuel pressures and at the same time, a smoothing level is changed according to the transitional or steady state of the engine, thereby achieving the response characteristic of correction at the transitional state and the stable correction at the steady state.

14 Claims, 6 Drawing Sheets

METHOD OF AND APPARATUS FOR CONTROLLING FUEL INJECTION OF INTERNAL COMBUSTION ENGINE

BACKGROUND OF THE INVENTION

1. Field of the Invention

The present invention relates to a method of and an apparatus for controlling fuel injection of an internal combustion engine, a technique of correcting the width of a fuel injection pulse based on detected values of fuel pressures.

2. Description of the Related Art

A direct injection (cylinder injection) type gasoline engine is disclosed in, for example, Japanese Unexamined Patent Publication No. 60-30420. This type of engine employs fuel injection valves to directly inject fuel into respective cylinders. Under a low load of the engine, each valve injects fuel in a later stage of a compression stroke, to form a dense air-fuel mixture around an ignition plug with suppressing dispersion of fuel. While, under a high load of the engine, each valve injects fuel in a first stage of an intake stroke, to actively disperse fuel.

With the direct injection type gasoline engine, since highly pressurized fuel is supplied to the fuel injection valves, a large quantity of fuel per unit time is injected. This may easily,drop the pressure of fuel due to the injection and fluctuate the fuel injection quantity.

Conventionally, in order to prevent such fluctuation of the fuel injection quantity due to the drop of fuel pressure, the width of a fuel injection pulse is corrected in response to fuel pressures detected by a fuel pressure sensor. In correcting the pulse width, in order to avoid that the pulse width shall be corrected under an influence of a high-frequency fluctuation in the fuel pressures, a weighted averaging technique, for example, is employed to smooth the fuel pressures.

However, the smoothing uses a constant smoothing level or a constant cutoff frequency without regard to an engine operating state. When the engine operating state is transitional, the smoothing is unable to follow a fluctuation in fuel pressures, and therefore, is unable to properly correct the pulse width in response to an actual fuel pressure. If the follow-up capability of the smoothing in the transitional state is maintained, however, the injection pulse width can not be stably corrected in a steady state because of a high-frequency fluctuation in fuel pressures in the steady operating state.

SUMMARY OF THE INVENTION

In view of the above problems, an object of the present invention is to, in an apparatus for controlling fuel injection which corrects the injection pulse width based on a detection result of fuel pressure, properly smooth detected fuel pressure values according to an engine operating state, and improve the accuracy of measurement of fuel injection quantity.

Another object of the present invention is to correct the fuel injection pulse width in response to a change in fuel pressures during a transitional engine operating state and stabilize the fuel injection pulse width correction by removing the influence of a high-frequency fluctuation in fuel pressures during a steady engine operating state.

Still another object of the present invention is to properly smooth detected fuel pressure values depending on an engine rotational speed.

In order to accomplish the objects, with the present invention which provides a method of and an apparatus for controlling fuel injection of an internal combustion engine, detected fuel pressure values are smoothed according to a smoothing level which is changed according to engine operating states and the fuel injection pulse width is corrected based on the smoothed fuel pressures.

With such a construction, the smoothing level is not constant when the detected fuel pressure values are smoothed and changed according to engine operating states, thereby the smoothing of detected fuel pressures is carried out with an optimal smoothing level for each operating state.

The smoothing of detected fuel pressure values is carried out by, for example, weighted averaging.

Here, the engine operating state, transitional or steady, is judged, and in accordance with the judgment result, the smoothing level may be changed over.

With such a construction, in the transitional state, the smoothing is carried out with the smoothing level capable of following a change in fuel pressures, and in the steady state, the stable correction can be carried out by sufficiently smoothing a change in fuel pressures.

Moreover, whether the engine operating state is transitional or steady is judged according to a change amount in the fuel injection pulse width.

With such a construction, if the change amount of the pulse width (for example, the absolute value of the change amount per unit time) is smaller than a predetermined value, it is judged that the engine operating state is steady, and if it is larger than the predetermined value, it is judged that the engine operating state is transitional.

The engine operating state may be judged according to a change in a signal that causes a change in the fuel injection pulse width.

This signal may be a throttle opening signal, a target air-fuel ratio signal, an accelerator opening signal, a torque request signal, or the like. The injection pulse width changes in response to changes in these signals.

Further, at least in one of the transitional and steady states of the engine, the smoothing level may be changed over according to an engine rotational speed.

Namely, the smoothing level may be changed over not only according to the engine operating state, transition or steady, but also according to the engine rotational speed.

If the smoothing level is changed over according to the engine rotational speed, as mentioned above, the higher the engine rotational speed becomes, the higher the cutoff frequency becomes.

With such a construction, the smoothing level is set so that the cutoff frequency becomes higher at the high rotation side where the fuel injection period becomes shorter.

A smoothing level set for the transitional state may be maintained for a predetermined period after the transitional state shifts to the steady state.

With such a construction, the smoothing level is not changed to a level according to the steady state immediately after it is judged that the transitional state has shifted to the steady state. The smoothing is carried out based on the smoothing level for the transitional state for the predetermined period until the steady state is stabilized.

Preferably, each of the fuel injection valves is so constructed to directly inject fuel into a cylinder. A low-pressure fuel pump supplies fuel from a fuel tank to a high-pressure fuel pump, and the high-pressure fuel pump supplies the fuel to the fuel injection valves. The pressure of the fuel supplied by the high-pressure fuel pump to the fuel injection valves is detected.

With such a construction, in a direct injection type gasoline engine susceptible to a pressure drop in fuel due to injection because of a large quantity of fuel injection a fluctuation in the fuel injection quantity due to the drop of fuel pressures can be corrected to a high accuracy.

Other objects and features of the present invention will be apparent from the description of preferred embodiments with reference to the accompanying drawings.

DESCRIPTION OF THE PREFERRED EMBODIMENTS

Embodiments of the present invention will be described hereinbelow with reference to the accompanying drawings.

Figure 1:
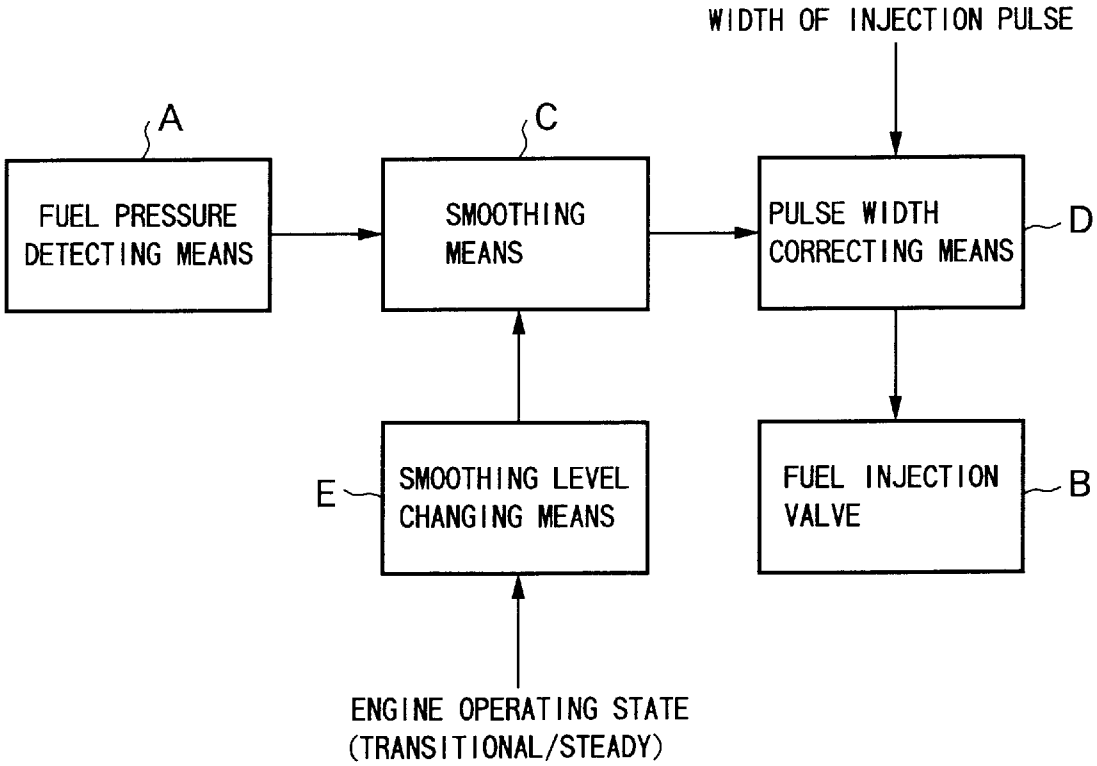
FIG. 1 shows a basic arrangement of an apparatus for controlling fuel injection of an internal combustion engine according to the present invention.

FIG. 1 shows a basic arrangement of an apparatus for controlling fuel injection of an internal combustion engine according to the present invention. A fuel pressure detecting means A detects the pressure of fuel (gasoline) supplied to a fuel injection valve B. A smoothing means C smooths the fuel pressures detected by the fuel pressure detecting means A according to, for example, weighted averaging technique. A pulse width correcting means D corrects the fuel injection pulse width calculated based on engine operating conditions such as an engine intake air flow quantity and an engine rotational speed, according to the smoothed fuel pressures. The corrected pulse width is applied to the fuel injection valve B, thereby fuel injection is carried out. A smoothing level changing means E changes a smoothing level to be used by the smoothing means C according to whether the engine operating state is transitional or steady.

Figure 2:
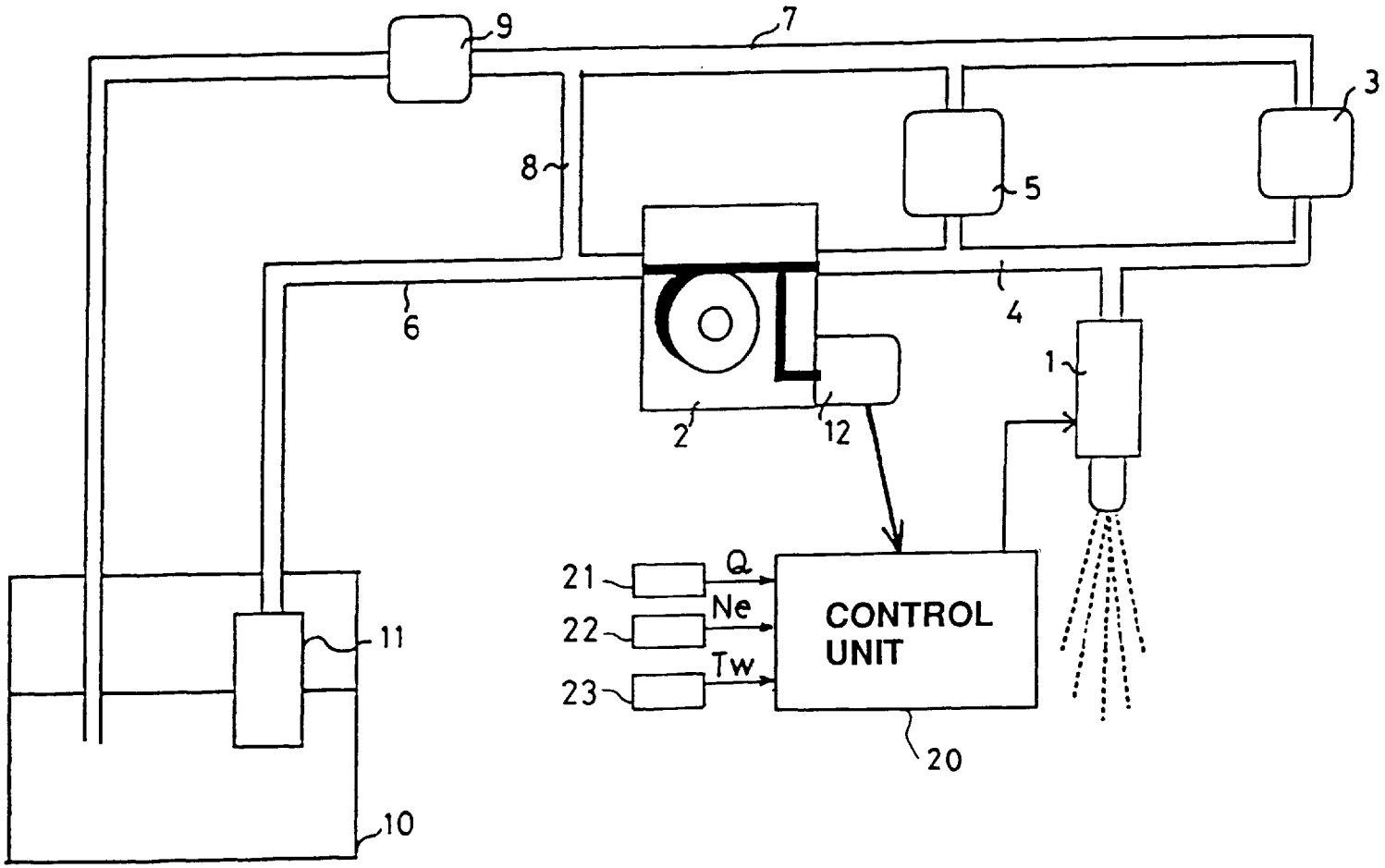
FIG. 2 shows a schematic diagram of fueling system according to an embodiment of the present invention.

FIG. 2 shows a fueling system of the apparatus for controlling fuel injection having the above basic arrangement. Respective fuel injection valves 1 are provided so as to face each cylinder of the engine, to directly inject fuel into the cylinder. Namely, the internal combustion engine of the present invention is a direct injection type gasoline engine.

The present embodiments will be described with reference to a direct injection (cylinder injection) type gasoline engine. However, the present invention is applicable not only to the direct injection type engines but also to intake port injection type gasoline engines.

The fuel injection valve 1 is of a solenoid type fuel injection valve, which opens when a solenoid thereof is supplied with an electric current and closes when the supply of electric current is interrupted. A control unit 20 determines the fuel injection pulse width according to engine operating states and applies the pulse to the fuel injection valve 1. During a previously set timing in, for example, a compression stroke, the fuel injection valve 1 opens for an interval corresponding to the pulse width so as to intermittently injection supply to the engine cylinder fuel which is fed under pressure via a high-pressure fuel pipe 4 from a high-pressure fuel pump 2 driven by the engine and adjusted to a predetermined high pressure by a high-pressure side pressure regulator 3.

Although only one fuel injection valve 1 is shown in FIG. 2, a plurality of fuel injection valves 1 facing each cylinder are connected to the high-pressure fuel pipe 4, respectively.

The high-pressure fuel pipe 4 is communicated with the high-pressure side pressure regulator 3 for adjusting the fuel pressure in the high-pressure fuel pipe 4 to a predetermined value and with a safety valve 5 for limiting the fuel pressure in the pipe 4 so as to become a high pressure. Excess fuel resulted from this adjustment is returned to a fuel tank 10 through a fuel return pipe 7 having a low-pressure side pressure regulator 9.

The high-pressure fuel pump 2 is supplied with the fuel sucked from the fuel tank 10 by an electrical feed pump 11 and controlled to a predetermined feed pressure through a low-pressure fuel supply pipe 6 having a check valve and a fuel filter (not shown). The adjustment of the feed pressure is carried out by the low-pressure side pressure regulator 9 communicated with the low-pressure fuel supply pipe 6 via a bypass pipes.

The high-pressure fuel pipe 4 has a fuel pressure sensor 12 serving as fuel pressure detecting means, for detecting a fuel pressure P in the high-pressure fuel pipe 4. A detection signal from the fuel pressure sensor 12 is input to the control unit 20.

The control unit 20 which electronically controls the supply of fuel to the engine by providing the fuel injection valve 1 with a fuel injection pulse signal, consists of a microcomputer having a CPU, a ROM, a RAM, A/D converters, I/O interfaces and the like. The control unit 20 receives signals from various sensors, carries out an operation based on these signals, and determines the width of the fuel injection pulse to be output to the fuel injection valve 1.

The various sensors connected to the control unit 20 include an airflow meter 21 for detecting an engine intake air flow quantity Q, a crank angle sensor 22 for providing a reference angle signal REF at each reference angle position and a unit angle signal POS at each one or two degrees, and a water temperature sensor 23 for detecting the temperature of cooling water of the engine, in addition to the fuel pressure sensor 12 mentioned above.

Based on the detection signals from the crank angle sensor 22, the control unit 20 calculates an engine rotational speed Ne.

The CPU of the microcomputer installed in the control unit 20 carries out an operation according to a program stored in the ROM and calculates a fuel injection pulse width Ti. At a predetermined injection timing, the control unit 20 supplies an injection pulse signal of the injection pulse width Ti to the fuel injection valve 1.

More specifically, the width Ti is calculated as follows:

$$Ti=Te\times KP+Ts$$

$$Te=Tp\times CO$$

where Te is an effective pulse width, KP is a fuel pressure correction coefficient, Ts is a voltage correction portion, Tp is a basic pulse width, and CO represents various correction coefficients. The basic pulse width Tp is a value determined based on the intake air flow quantity Q and engine rotational speed Ne and the fuel quantity necessary for forming an air-fuel mixture of a target air-fuel ratio corresponding to the cylinder intake air quantity at the time is calculated as an injection valve open time under a predetermined high fuel pressure adjusted by the high-pressure regulator 3.

The voltage correction portion Ts is to deal with an increase in an invalid fuel injection quantity due to a drop in a battery voltage.

For example, the various correction coefficients CO are calculated as:

$$CO=(1+K_{MR}+K_{TW}+K_{AS}+K_{ACC}+K_{DC}+\ldots)$$

where KMR is an air-fuel ratio correction coefficient, $K_{TW}$ is an incremental correction coefficient depending on the water temperature, $K_{AS}$ is an incremental correction coefficient at the start and after the start, $K_{ACC}$ is an incremental correction coefficient during acceleration, and $K_{DC}$ is a decremental correction coefficient during deceleration.

In addition the effective pulse width Te may be calculated in consideration of an air-fuel ratio feedback correction coefficient $\alpha$ and an air-fuel ratio learning correction coefficient $K_{LRN}$ and the like.

The fuel pressure correction coefficient KP is the one for correcting the effective pulse width Te when an actual fuel pressure fluctuates up and down from the pressure adjusted by the high-pressure side pressure regulator 3. Namely, the effective pulse width Te is a value calculated, provided that the fuel pressure is adjusted by an adjustment function of the high-pressure side pressure regulator 3. Accordingly, if the actual fuel pressure fluctuates up and down, it is unable to inject a fuel quantity proportional to the effective injection pulse width Te, causing excess or lack in the actual injection quantity.

Therefore, the fuel pressure correction coefficient KP is used to correct the pulse width based on the detected fuel pressure values so that a desired fuel quantity is injected even if the fluctuation in fuel pressure occurs. The fuel pressure correction coefficient KP is determined according to the flowchart of FIG. 3.

Figure 3:
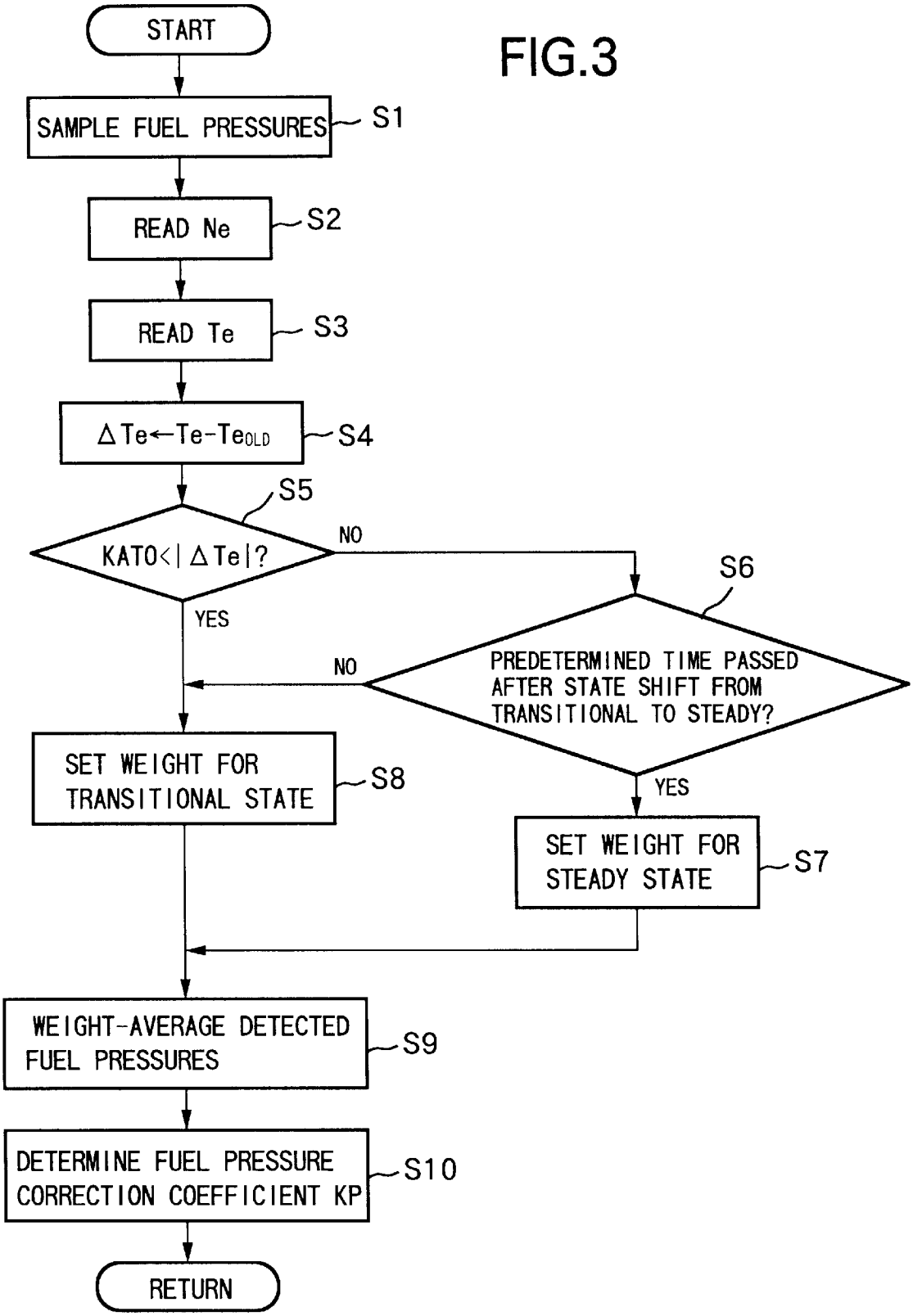
FIG. 3 is a flowchart showing a routine of setting a fuel pressure correction coefficient according to an embodiment of the present invention.

Functions of the smoothing means C, pulse width correcting means D, smoothing level changing means E, and transitional/steady state judging means, are possessed by the control unit 20 in a software manner as shown in the flowchart of FIG. 3

In step 1 of FIG. 3, detection signals from the fuel pressure sensor 12 are converted from analog to digital and are read.

The sampling periods of the detection signals from the fuel pressure may be constant or random periods may be set so that the sampling periods may not agree with the period of fluctuation in the detection signal.

In step 2, the engine rotational speed Ne is read and in step 3, the effective pulse width Te is read.

In step 4, a change amount ΔTe of the effective injection pulse width Te is calculated as the difference between the previous value and the present value (ΔTe=Te−Teold).

In step 5, it is judged if the absolute value of the change amount ΔTe is greater than a threshold value KATO.

If the absolute value of the change amount ΔTe is greater than the threshold value KATO, it is judged that the engine 1 is in the transitional state, and if not greater, it is judged that the engine 1 is in the steady state.

If the engine 1 is judged to be in the steady operating state, the program proceeds to step 6 wherein it is judged if a predetermined time has passed after the transitional state has shifted to the steady state.

If the predetermined time has already passed, the program proceeds to step 7.

In step 7, a previously set weight value for the steady operating state is selected as a weight to be used for a weighted averaging operation (smoothing) of the fuel pressures detected in step 1. The weight may be a fixed value or may be set according to the engine rotational speed Ne. With the present invention, the weight indicates a weighting level for the past data. The larger the weight, the larger the smoothing level.

When the weight is changed according to the engine rotational speed Ne, it is reduced as the speed Ne increases, and the fuel injection interval becomes shorter, so that the weight may participate in the pulse width correction control to a higher frequency component.

Figure 4:
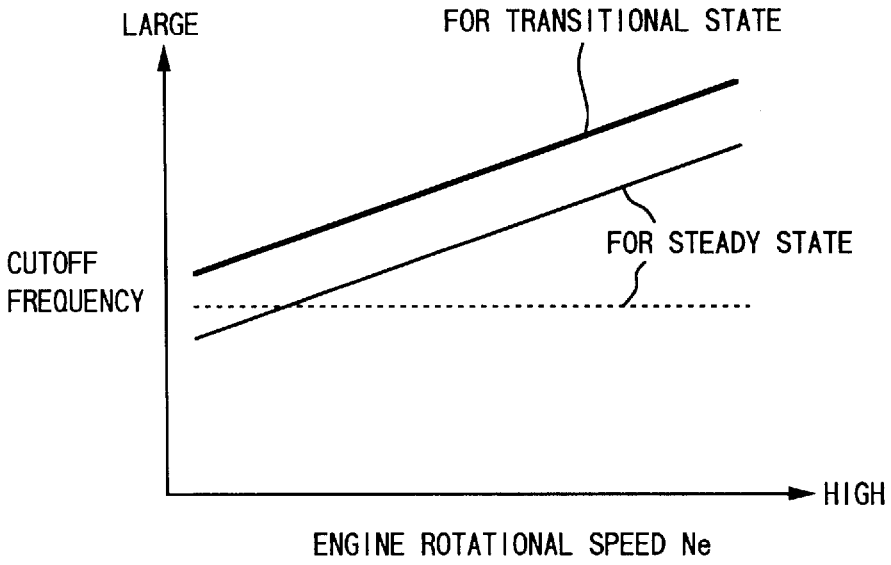
FIG. 4 shows a graph of weighted averages for transitional and steady states.

Instead of the weighted averaging, it is possible to employ a construction for variably setting the cutoff frequency in a digital or analog low-pass filter. In FIG. 4, the weight in the weighted averaging operation is indicated as cutoff frequencies. In FIG. 4, any component in a region equal to or below the cutoff frequencies is passed. When the cutoff frequency is changed according to the engine rotational speed Ne, the higher the engine rotational speed Ne, the higher the cutoff frequency is set (the lower the smoothing level is set).

If in step 5, it is judged that the engine operating state is transitional, and in step 6, it is judged that the predetermined time has not passed yet, programs proceeds to step 8 wherein a previously set weight value for the transitional operating state is selected as a weight to be used for the weighted averaging operation (smoothing) on the fuel pressure sampled in step 1.

Namely, the weight for the transitional state is set not only for the transitional operating state but also for a state just after the transitional state shifts to the steady state even in a state wherein the fuel pressure has not yet been stabilized immediately after the shift from the transitional to the steady, to thereby follow a change in fuel pressures.

Figure 6:
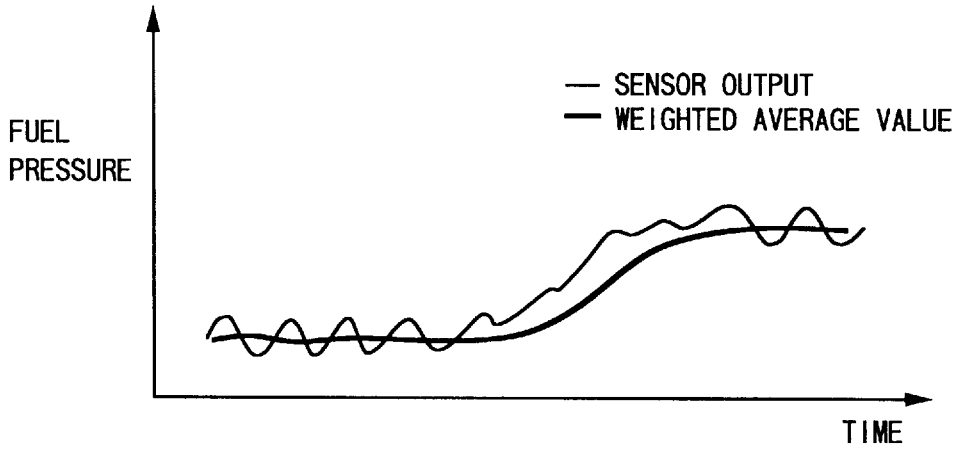
FIG. 6 is a graph showing a response characteristic when weighted average value of fuel pressures is obtained with the same weight for transitional and steady states according to a prior art.

As shown in FIG. 4 as the cutoff frequency, the weight for the transitional operating state is smaller than that for the steady operating state and is set to be a higher value as the cutoff frequency. As a result of the weighted averaging, it is possible to obtain a value following a change in fuel pressures in the transitional operating state. Consequently, it can avoid that, in such a case that the same weight is used for smoothing both for the transitional and steady states, a response delay will occur in the transitional state as shown in FIG. 6. Moreover, in the steady state, more stable correction control can be carried out with a sufficient smoothing.

Here, the weight (the cutoff frequency) may be fixed for the steady operating state. The weight (the cutoff frequency) for the transitional operating state, however, is preferable to be changed according to the engine rotational speed Ne. Namely, even in the transitional state, a change in fuel pressure is increased at a high rotation side where the fuel injection interval is short, therefore, to smooth the change in the fuel pressure for each injection to detect the change in the averaged fuel pressures, it is preferable to make the weight smaller, or to make the cutoff frequency higher according to the increase in the engine rotational speed.

After the weight (cutoff frequency) has been set in step 7 or 8, in step 9, the detected values of the fuel pressures are weighted averaged according to the set weight.

In step 10, the fuel pressure correction coefficient KP is set based on the weighted average value P of the fuel pressures as, for example, $KP=k/P^{1/2}$. Here, k is a fixed value previously set so that the correction coefficient KP becomes 1.0 when the fuel pressure is equal to the pressure adjusted by the high-pressure side pressure regulator 3. With the correction by the correction coefficient KP, it is possible to inject a desired fuel quantity even if the fuel pressure fluctuates.

The correction of the fuel injection pulse width based on the weighted average value of detected fuel pressures is not limited to that with the correction coefficient $KP=k/P^{1/2}$ and this may be the correction for corresponding to a change in a valve operation delay due to a change in fuel pressures, or the correction for corresponding to a change in atomized fuel patterns.

In the flowchart of FIG. 3, it is judged whether the engine operating state is transitional or steady based on a change in the fuel injection pulse width. By judging if the engine operating state is transitional or steady based on a signal that causes a change in the fuel injection pulse width, the weight can be changed without delay.

Figure 5:
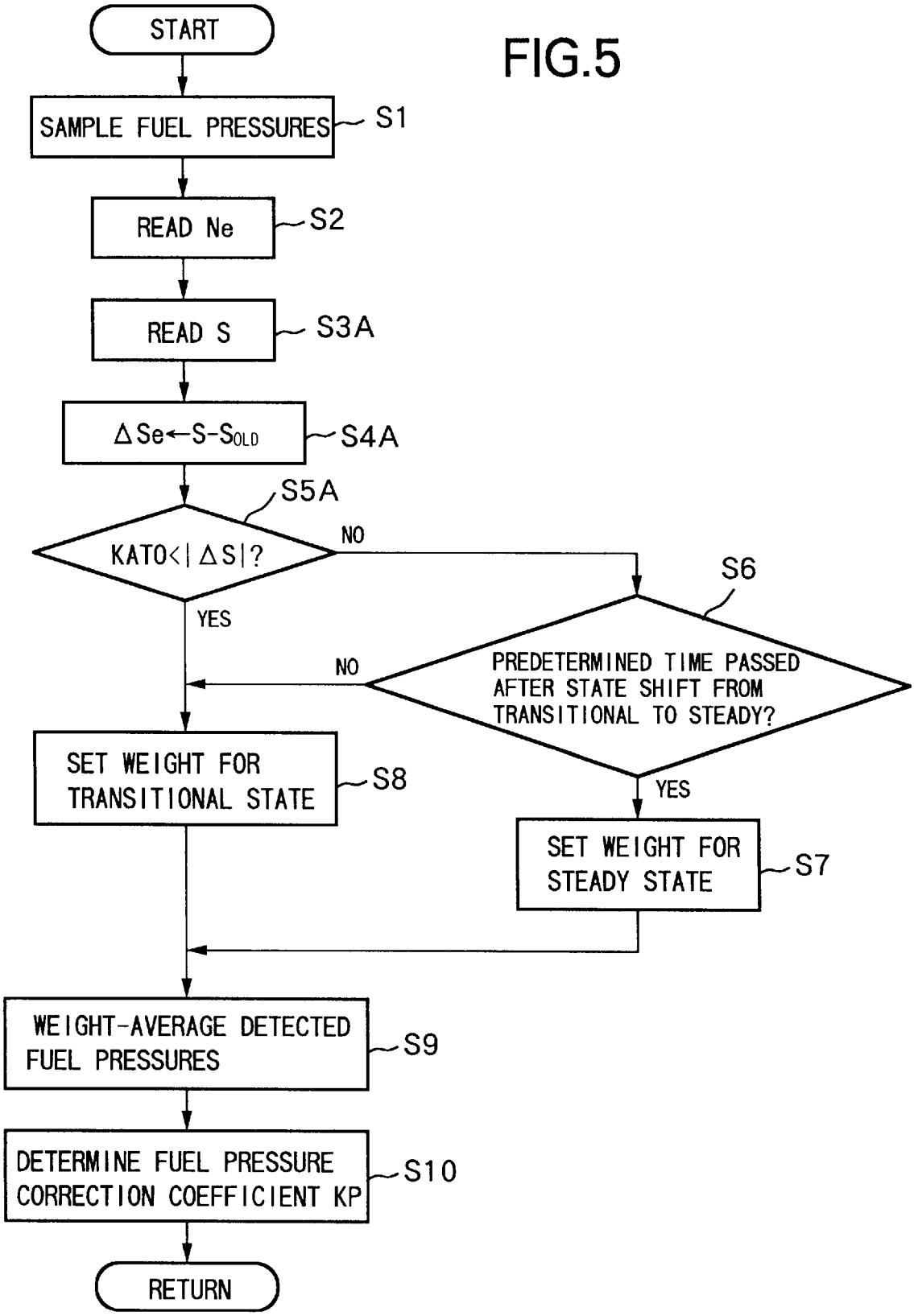
FIG. 5 is a flowchart showing a routine of setting a fuel pressure correction coefficient according to another embodiment of the present invention.

FIG. 5 shows a flowchart, for setting and controlling the fuel pressure correction coefficient KP when it is judged if the engine operating state is transitional or steady based on a signal that causes a change in the fuel injection pulse width Proceedings of respective steps are the same as those of the flowchart of FIG. 3 except for steps 3A through 5A. Accordingly, only the judgment of the engine operating state shown in steps S3A to S5A will be explained.

In step 3A, a signal S that causes a change in the fuel injection pulse width is read.

The signal S may be a throttle opening signal, a target air-fuel ratio signal, an accelerator opening signal, or a torque request signal. The torque request signal may be a torque down request signal at shifting up in an automatic transmission, or a torque down request signal used for traction control.

In step 4A, a change amount ΔS in the signal S is calculated and in step 5A, the absolute value of the change with a threshold value KATO are compared. If the change amount ΔS is greater than the threshold value KATO, it is judged that the engine operating state is transitional.

More specifically, for example, if a change in a throttle opening is greater than a threshold value, it is judged that the engine operating state is transitional, and if the same is equal to or below the threshold value and is substantially constant, the engine operating state is judged to be steady.

A change in the fuel injection pulse width occurs always after a change in the signal S, and therefore, a change in fuel pressures due to the transitional state is detectable beforehand to select a weight for the transitional/steady state in a good response characteristic.

What is claimed is:

1. An apparatus for controlling fuel injection of an internal combustion engine which calculates the fuel injection pulse width according to an engine operating state and intermittently opens each fuel injection valve based on the fuel injection pulse, comprising:

fuel pressure detecting means for detecting fuel pressures supplied to the fuel injection valve;

smoothing means for smoothing the fuel pressures detected by said fuel pressure detecting means;

pulse width correcting means for correcting the fuel injection pulse width based on the detected values of the fuel pressure smoothed by said smoothing means;

transition/steady judging means for judging whether the engine operating state is transitional or steady; and smoothing level changing means for changing a smoothing level according to whether the engine operating state judged by said transition/steady judging means is transitional or steady.

2. The apparatus of claim 1, wherein said transition/steady judgment means judges whether the engine operating state is transitional or steady based on a change in the fuel injection pulse width.

3. The apparatus of claim 1, wherein said transition/steady judgment means judges whether the engine operating state is transitional or steady based on a change in a signal that causes a change in the fuel injection pulse width.

4. The apparatus of claim 1, wherein said smoothing level changing means changes the smoothing level according to an engine rotational speed in at least one of the transitional and steady states.

5. The apparatus of claim 4, wherein said smoothing level changing means changes the smoothing level so that a cutoff frequency may rise as the engine rotational speed rises.

6. The apparatus of claim 1, wherein said smoothing level changing means maintains a smoothing level for the transitional state for a predetermined period after the transitional state shifts to the steady state.

7. The apparatus of claim 1, wherein the fuel injection valve directly injects fuel into a cylinder, and wherein a low-pressure fuel pump supplies fuel from a fuel tank to a high-pressure fuel pump, said high-pressure fuel pump supplies the fuel to the fuel injection valve, and said fuel pressure detecting means detects fuel pressures supplied to the fuel injection valve by the high-pressure fuel pump.

8. A method of controlling fuel injection of an internal combustion engine wherein the fuel injection pulse width is calculated according to an engine operating state and each fuel injection valve is intermittently opened based on the fuel injection pulse width, wherein fuel pressures supplied to the fuel injection valve is detected, the detected fuel pressure values are smoothed with a smoothing level according to the engine operating state and the fuel injection pulse width is corrected based on the smoothed detected fuel pressure values, comprising the steps of:

judging whether the engine operating state is transitional or steady; and changing the smoothing level in the smoothing of the detected fuel pressure values according to the judgement result.

9. The method of claim 8, wherein it is judged whether the engine operating state is transitional or steady based on a change in the fuel injection pulse width.

10. The method of claim 8, wherein it is judged whether the engine operating state is transitional or steady based on a change in a signal that causes a change in the fuel injection pulse width.

11. The method of claim 9, wherein the smoothing level is changed according to an engine rotational speed in at least one of the transitional and steady states.

12. The method of claim 11, wherein the smoothing level is changed so that a cutoff frequency rises as the engine rotational speed rises.

13. The method of claim 9, wherein a smoothing level for the transitional state is maintained for a predetermined period after the transitional state shifts to the steady state.

14. The method of claim 8, wherein the fuel injection valve directly injects fuel into a cylinder, and wherein a low-pressure fuel pump supplies fuel from a fuel tank to a high-pressure fuel pump, said high-pressure pump supplies the fuel to the fuel injection valve, and fuel pressures supplied to the fuel injection valve by the high-pressure fuel pump are detected.

* * * * *